United States Patent [19]

Brands et al.

[11] Patent Number: 4,513,660

[45] Date of Patent: Apr. 30, 1985

[54] IMPRESSION ROLLER FOR LIMITING CHARGE DISTRIBUTION

[75] Inventors: George B. Brands, Wilmette; Bruce E. Hyllberg, Gurnee, both of Ill.

[73] Assignee: American Roller Company, Union Grove, Wis.

[21] Appl. No.: 644,645

[22] Filed: Aug. 24, 1984

Related U.S. Application Data

[63] Continuation of Ser. No. 584,615, Feb. 29, 1984, abandoned.

[51] Int. Cl.[3] ..... B41F 13/18

[52] U.S. Cl. ..... 101/1; 101/219; 101/426; 29/132

[58] Field of Search ..... 101/219, 212, 216, 152, 101/153, 170, 426, 174, 176, DIG. 13; 29/125, 130, 132; 355/3 DR; 315/307, 291

[56] References Cited

U.S. PATENT DOCUMENTS

| | | | |
|---|---|---|---|
| 2,520,504 | 8/1950 | Hooper | 101/219 X |
| 3,477,369 | 11/1969 | Adamson et al. | 101/170 X |
| 3,625,146 | 12/1971 | Hutchison | 101/153 |
| 4,099,462 | 7/1978 | Coberley et al. | 101/170 X |
| 4,364,313 | 12/1982 | Hyllberg | 101/401.1 |

*Primary Examiner*—J. Reed Fisher

*Attorney, Agent, or Firm*—Quarles & Brady

[57] ABSTRACT

An impression roller for electrostatically assisted printing distributes a charge across a web of packaging material. The roller has considerably more resistance in the longitudinal direction than in the circumferential direction to restrict the distribution of charge to portions of the roller extending beyond the web. The lower resistance in the circumferential direction is provided by a set of looped conductors—either conductive rubberized strips or wire loops—which are embedded in an outer layer of semiconductive material of the roller to allow electrical current traveling in the circumferential direction to bypass portions of the semiconductive material. The electrical current encounters considerably more resistance in the longitudinal direction, because the conductors are spaced longitudinally along the rollers at intervals and any current traveling from one looped conductor to another travels through the semiconductive material.

3 Claims, 6 Drawing Figures

IMPRESSION ROLLER FOR LIMITING CHARGE DISTRIBUTION

This application is a continuation of application Ser. No. 584,615, filed Feb. 29, 1984, now abandoned.

BACKGROUND OF THE INVENTION

The invention relates to an impression roller for use in electrostatically assisted printing.

In this method of printing, the transfer of ink from a printing design cylinder to a web of material such as paper, paperboard, fabric or plastic film, is assisted by the electrostatic attraction of ink to the web. This is accomplished by passing the web through a nip region, where the web is contacted on its topside by the impression roller and on its underside by the printing design roller. A voltage is applied to the impression roller and current is conducted through it to the area of the nip region. There, a voltage is generated between the impression roller and the printing design roller which is at ground potential, and an electrical charge is distributed across the area of the web contacting the two rollers.

Impression rollers have generally been of two types: a two-layer roller and a three-layer roller. In the two-layer roller, an insulated core is covered with an outer layer of semiconductive material. A voltage is applied to the outer layer of semiconductive material at the top of the roller, so that current travels through the semiconductive layer to reach the nip region at the bottom of the roller. In the three-layer roller, a layer of material considerably more conductive than the semiconductive material is disposed around the insulated core, but beneath the outer surface and the semiconductive layer. When a voltage is applied across the top of the impression roller, current travels through the semiconductive material to the relatively more conductive layer. It then bypasses a great portion of the semiconductive layer as it travels around the circumference of the roller to the nip region. This results in the three-layer roller having considerably less resistance than a two-layer roller with a comparable semiconductive layer.

Printing applications are numerous and varied, and the owner of an electrostatically assisted printing machine may desire to print images on webs of varying widths. In some instances the webs may be considerably narrower in width than the length of the rollers over which it travels. In those instances there is a great deal of excess electrical energy dissipated in areas of the impression roller that extend beyond the web.

To remedy this, a voltage has been applied through a group of stainless steel sliding blades. The blades outside the width of web are lifted to a disengaging position to shorten the effective width over which voltage is applied to the impression roller. This system, however, is not apparently suitable for use with a three-layer roller, because substantial current would travel to the ends of the roller as well as around its circumference, due to the charge-distributing function of the conductive layer.

SUMMARY OF THE INVENTION

The invention is embodied in a machine roller which provides greater electrical resistance in the longitudinal direction than in the circumferential direction to limit the distribution of current in regions of the roller extending longitudinally beyond the region where the potential is applied.

Such a roller has an elongated body with an insulated cylindrical core and a layer of semiconductive material extending around the insulated core to allow current to flow between a first region of higher voltage and a second region of lower voltage. A set of conductive elements are spaced along the length of the roller, with each conductive element encircling the insulated core and contacting the semiconductive layer beneath its outer surface. The conductive elements each have an electrical resistance of at least two orders of magnitude less than the electrical resistance through twice the thickness of the layer of semiconductive material. This provides a roller with substantially greater resistance in the longitudinal direction than in the circumferential direction where the conductive elements act to reduce the resistance.

The general object of the invention is to limit charge distribution outside the nip area to reduce power and energy requirements for printing on webs that are narrower than the widest web that can be handled by the printing machine.

Another object of the invention is to provide an impression roller with a resistance characteristic of a three-layer roller in the circumferential direction and a resistance characteristic of a two-layer roller in the longitudinal direction.

The foregoing and other objects and advantages of the invention will appear from the following description in which reference is made to the accompanying drawings which form a part hereof, and in which there is shown by way of example two preferred embodiments of the invention. These embodiments do not necessarily represent the full scope of the invention, as this is reserved for the claims that follow the description.

DESCRIPTION OF THE PREFERRED EMBODIMENTS

Figure 1:
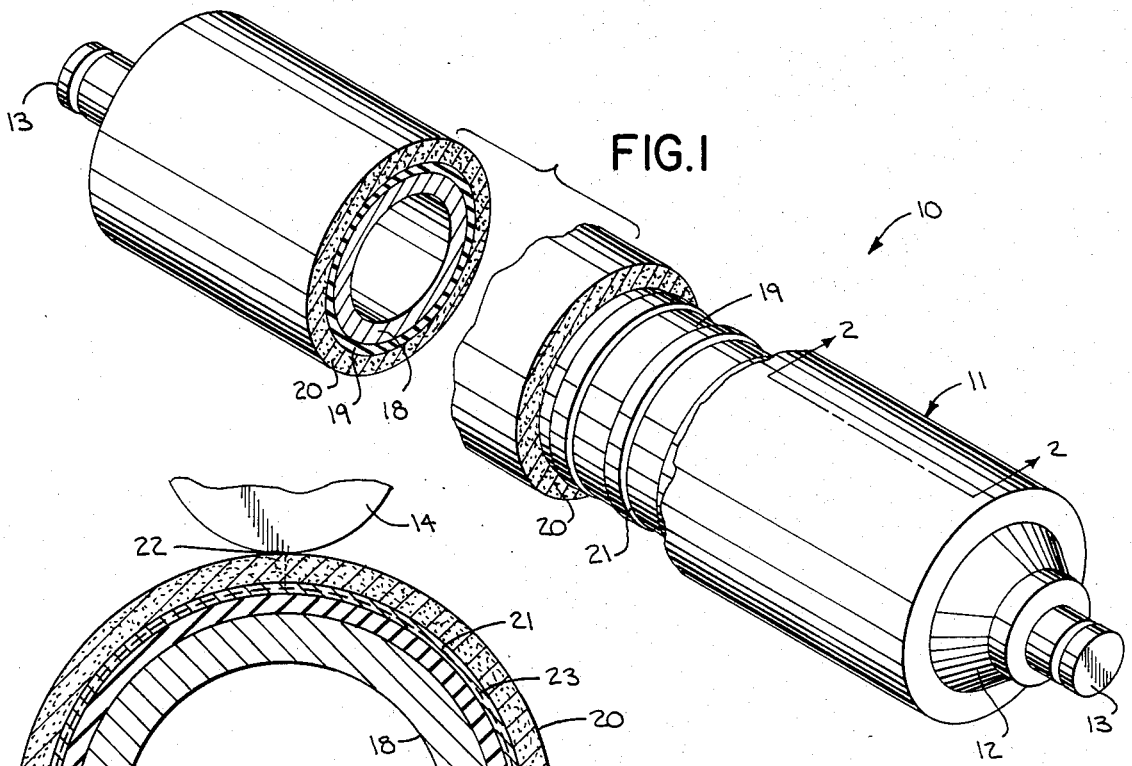
FIG. 1 is a perspective view of an impression roller of the present invention with parts broken away.

Referring to FIG. 1, a first embodiment of an impression roller 10 that incorporates the present invention is a type used in a printing machine (not shown). The roller 10 has an elongated, cylindrical body 11 that is closed on its opposite ends by hubs 12. A pair of journal shafts 13 extend from the hubs 12 on opposite ends to be received in bearings of the printing machine.

A printing machine of the general type in which such a roller 10 may be employed is described and illustrated in Adamson et al, U.S. Pat. No. 3,477,369, issued Nov. 11, 1969. As described there, the impression roller 10 is journaled in bearings for rotation between a printing design cylinder (engraved) and a back-up roller for applying a voltage to the impression roller. The rollers are all journaled in respective bearings for rotation.

As seen schematically in FIG. 3, a voltage application roller 14 is located above the impression roller 10, while the printing design roller 15 is located below. Printed matter is transferred to a web 16 of a material, such as paper, paperboard, fabric, plastic film, a laminate, or types of packaging material, by feeding the web 16 through a nip region 17 where the impression roller 10 and the printing design cylinder 15 bear against each other through the web 16. The printed matter is transferred both by directly impressing and by electrostatically attracting ink to the web 16 in a pattern determined by the design on the printing design cylinder 15. The present invention is related to the characteristics of an impression roller 10 which affect the electrostatic attraction of ink to the web 16.

Figure 3:
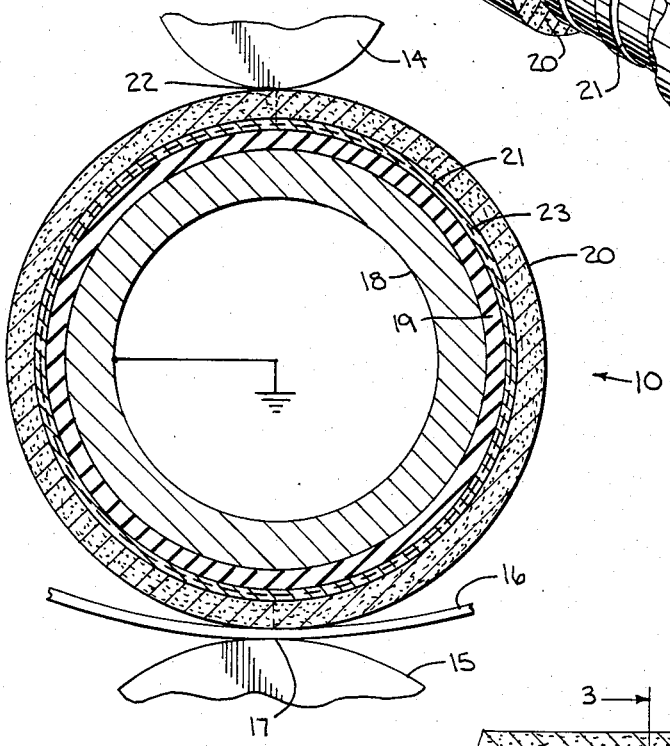
FIG. 3 is a transverse sectional view taken in the plane indicated by line 3—3 in FIG. 2.
Figure 2:
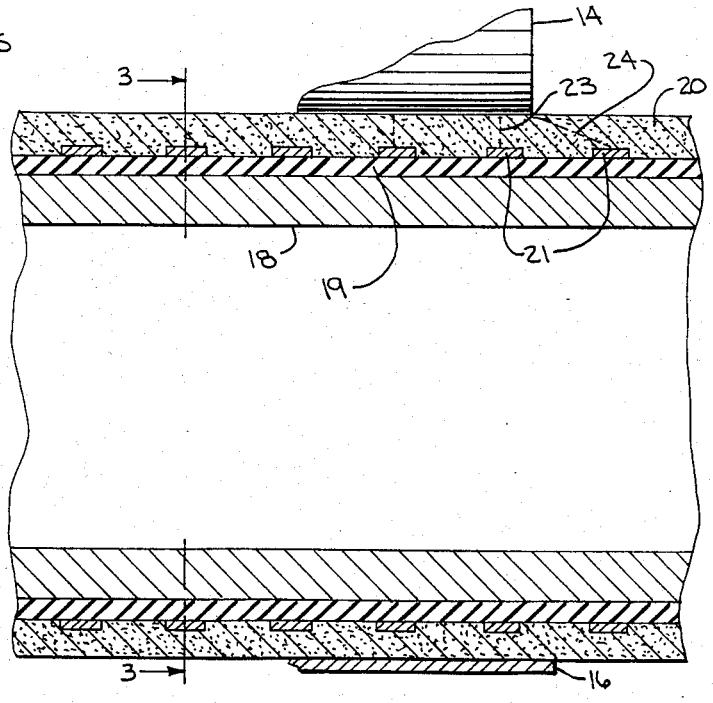
FIG. 2 is a fragmentary, longitudinal section view taken in the plane indicated by line 2—2 in FIG. 1.

As seen in FIGS. 1–3, the impression roller 10 has a tubular core 18 that is preferably made of metal. The core 18 is insulated by covering it with an inner layer 19 of insulating material to separate the core 18 from an outer layer 20 of semiconductive material. The insulating material is preferably a natural or synthetic rubber, or a mixture of these, but other known insulating materials can also be used. The preferred material in the outer layer 20 is resilient and has an electrical resistivity in a range from $10^6$ ohm—centimeters to $10^9$ ohm—centimeters and a relative hardness in the range from 60 to 95 according to the Shore A scale. A chlorinated synthetic elastomer such as epichlorohydrin is suitable for use in the semiconductive layer 20. In addition, other semiconductive materials including natural or synthetic materials, that exhibit the above described electrical characteristics can also be employed. Furthermore, while resilient materials are preferred, in some applications non-resilient materials can also be used.

Still referring to FIGS. 1–3, the roller 10 includes a set of conductive bands 21. The bands are formed by conductive strips of synthetic rubber, each of which encircles the insulated core. These bands are spaced along the length of the roller, i.e. longitudinally relative to the roller, at regular intervals. As seen in FIGS. 2 and 3 the conductive bands 21 lie close to the boundary between the outer semiconductive layer 20 and the inner, insulating layer 19. The bands 21 are completely covered by the semiconductive layer 20.

The volume resistivity of the material of the conductive bands 21 is preferably at least two orders of magnitude less than the volume resistivity of the material in outer layer 20. The invention is applicable wherever it is desired to provide conductive bands 21 of negligible resistance when compared with the resistance through twice the thickness of the semiconductive layer 20. For purposes of this description, where the resistance through one half of the mean circumferential length of a conductive band is equal to or less than 1% of the resistance through twice the thickness of the semiconductive layer, it is considered to be negligible.

Referring to FIG. 3, in a typical arrangement, a d.c. voltage of 1500 volts is supplied through the voltage application roller 14. This voltage is applied to a first region 22 of the outer surface of the semiconductive layer 20 and is conducted to a second region of the roller 10, which in this example is the nip region 17. The printing design roller 15 is electrically grounded, as is the frame of the printing machine, so that a current will be transmitted through the impression roller 10 to the nip region 17. A suitable range for current in the nip region 17 is from 0.5 to 3 milliamperes.

As seen in FIG. 3, application of the electrical voltage in the first region of the roller will cause operating current (represented by dashed line 23) to be conducted radially through a first thickness of the semiconductive outer layer 20, then around the roller in the circumferential direction through the conductive bands 21, and then radially through a second thickness of the semiconductive outer layer 20.

The roller 14 for applying the electrical voltage in FIG. 3 is shorter than the width of the web 16. As seen in FIG. 2, this roller 14 does not extend all the way to the end of the impression roller 10, and is not therefore disposed over all of the conductive bands 21. For electrical current to reach the outlying conductive bands 21 it must travel longitudinally along the roller, as well as radially inward (illustrated by dashed line 24). This requires that the current travel through the semiconductive layer 20, but due to the much higher resistance through that layer than through the conductive bands 21 very little current will travel in the longitudinal direction. Instead, the bulk of the current will be conducted through conductive bands 21 in the circumferential direction.

In this embodiment the conductive bands 21 are each one-half inch in width and the space between adjacent bands is one inch. Spacing of one-half inch is suitable as is spacing of two inches or four inches between conductive bands 21.

Figure 4:
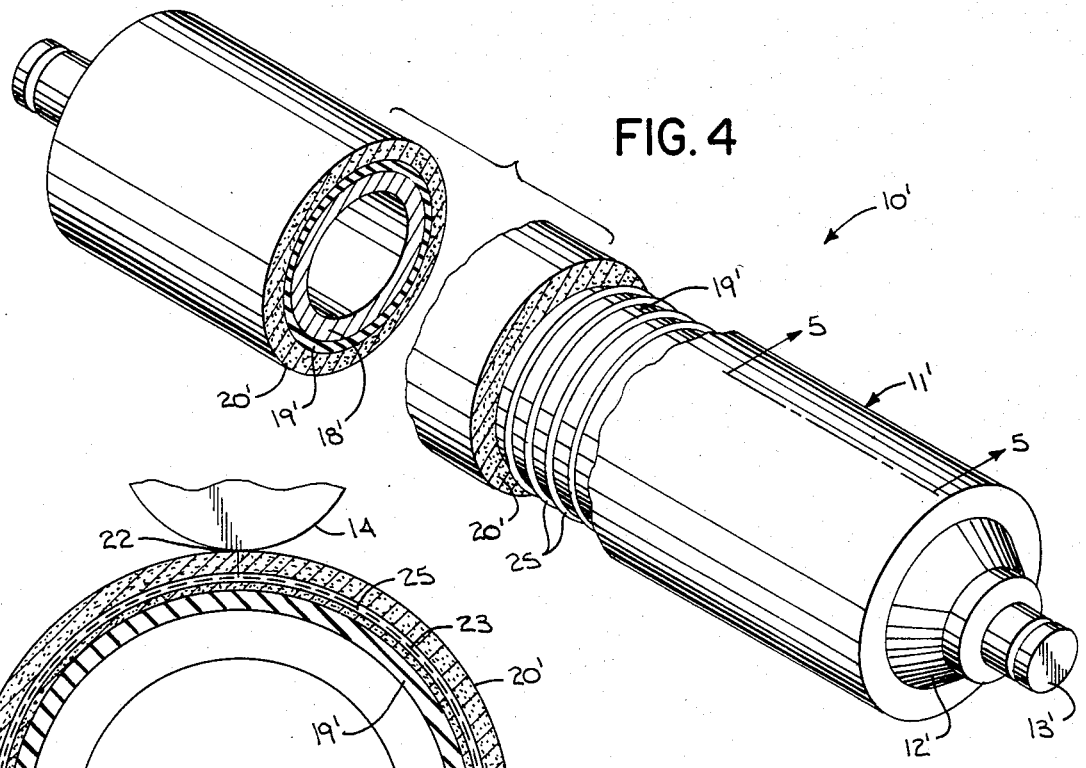
FIG. 4 is a perspective view of a second embodiment of an impression roller that incorporates the present invention with parts broken away.
Figure 6:
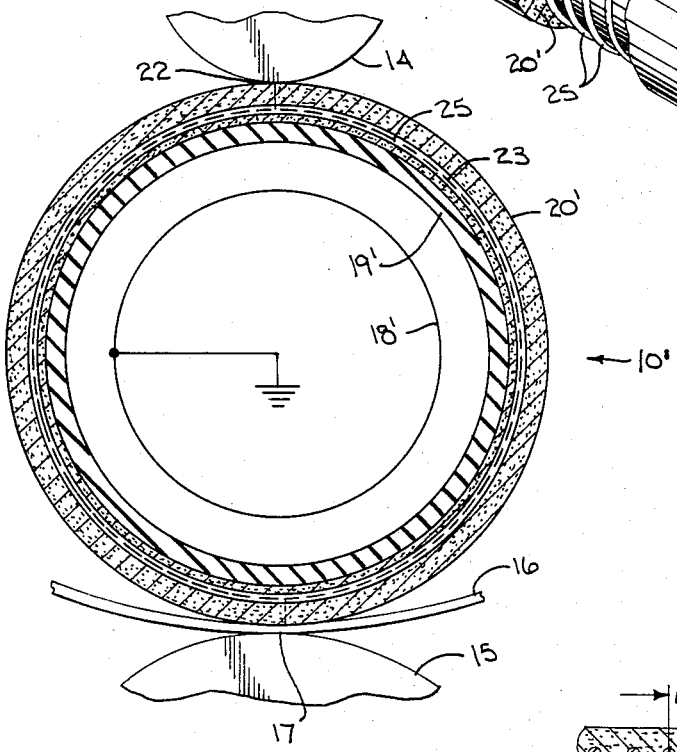
FIG. 6 is a transverse sectional view taken in the plane indicated by line 6—6 in FIG. 5.
Figure 5:
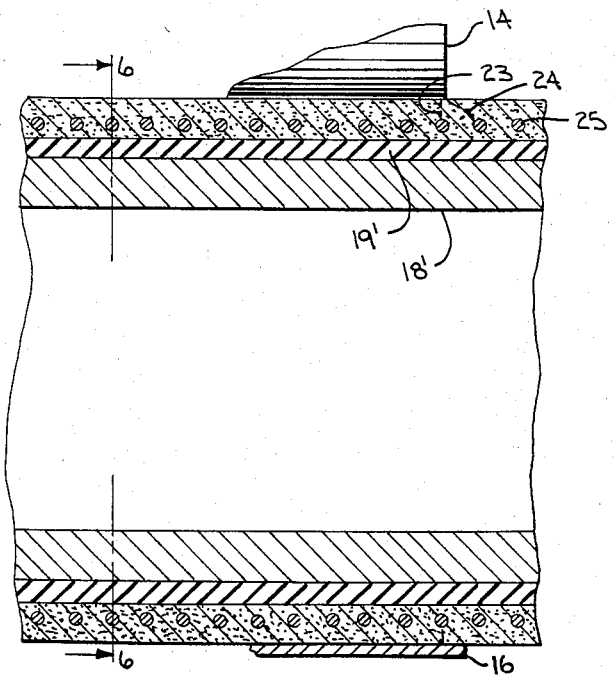
FIG. 5 is a fragmentary, longitudinal section view taken in the plane indicated by line 5—5 in FIG. 4.

FIGS. 4–6 show a second embodiment of the invention in which the basic roller 10' is similar to the first embodiment. The relationship of the parts of the second embodiment to the parts of the first embodiment has been indicated by assigning numbers with the prime notation. An exception to this similarity is that the conductive elements are formed by brass wire loops 25. As seen best in FIG. 5 these loops 25 are spaced along the length of the roller 10' at intervals of about one-half inch and are embedded in the outer layer 20' of semiconductive material. The resistance of the brass wire is less than 1 ohm per ten feet. The semiconductive material has the same electrical and mechanical characteristics as in the first embodiment so that the brass wire loops 25 provide conductive elements of negligible resistance.

Like the first example, the voltage application roller 14 in FIG. 5 does not extend to the end of the impression roller 20', and is shorter than the width of the web 16. This results in current being conducted primarily in the circumferential direction and limited to that portion of the roller 20' to which the voltage is applied.

While two embodiments of the impression roller of the invention have been disclosed it should now be apparent that other types of conductive elements could be used to reduce resistance in the circumferential direction, and that these types of conductive elements are deemed to be within the scope of the invention. Therefore, to fairly define the scope of the invention, the following claims are made.

I claim:

1. A machine roller for conducting electrical current from a first region of relatively higher voltage to a second region of relatively lower voltage, the roller comprising:

an elongated body including an insulated cylindrical core and a layer of semiconductive material extending around the insulated core to provide the first and second regions of differing electrical voltage when electrical current is conducted through the semiconductive layer; and a set of conductive elements spaced longitudinally along the body of the roller, each conductive element encircling the insulated core and contacting the semiconductive layer beneath the outer surface thereof, and each conductive element having an electrical resistance of at least two orders of magnitude less than the electrical resistance through twice the thickness of the layer of semiconductive material; and the roller providing greater electrical resistance in the longitudinal direction than in the circumferential direction to limit electrical current in regions of the roller extending longitudinally beyond the first region of relatively higher voltage.

2. The machine roller of claim 1 wherein the conductive elements are conductive strips of a rubber-based material.

3. The machine roller of claim 1 wherein the conductive elements are loops of wire.

* * * * *